US006264744B1

(12) United States Patent
Vaccani

(10) Patent No.: US 6,264,744 B1
(45) Date of Patent: Jul. 24, 2001

(54) HEAD FOR APPLYING ADHESIVE TO PREDEFINED REGIONS OF PRODUCTS IN GENERAL

(76) Inventor: Lucio Vaccani, Via Capodistria, 21, 23900 Lecco (IT)

( * ) Notice: Subject to any disclaimer, the term of this patent is extended or adjusted under 35 U.S.C. 154(b) by 0 days.

(21) Appl. No.: 09/621,080

(22) Filed: Jul. 21, 2000

(30) Foreign Application Priority Data

Jul. 26, 1999 (IT) ..... MI99A1644

(51) Int. Cl.[7] ..... B05C 5/00

(52) U.S. Cl. ..... 118/72; 118/300; 156/578

(58) Field of Search ..... 156/153, 350, 156/356, 535, 524, 578; 118/695, 696, 708, 72, 300, 320; 36/19.5

(56) References Cited

U.S. PATENT DOCUMENTS 2,536,183 * 1/1951 Jamieson ..... 428/525
3,568,638 * 3/1971 Isaac ..... 118/323
4,820,580 * 4/1989 Hocker et al. ..... 428/314.4

FOREIGN PATENT DOCUMENTS

3840130 C1 * 11/1988 (DE) .

* cited by examiner

*Primary Examiner*—Mark A. Osele
*Assistant Examiner*—Yewebdar T. Tadesse
(74) *Attorney, Agent, or Firm*—Guido Modiano; Albert Josif; Daniel O'Byrne

(57) ABSTRACT

A head for applying adhesive in predefined regions of products in general, comprising at least one means for carding the surface to be treated which acts directly before at least one nozzle for applying a layer of adhesive material to the carded surface.

14 Claims, 3 Drawing Sheets

HEAD FOR APPLYING ADHESIVE TO PREDEFINED REGIONS OF PRODUCTS IN GENERAL

BACKGROUND OF THE INVENTION

The present invention relates to a head for applying adhesive to predefined regions of products in general.

It is known that in many industrial fields, and particularly in the shoe industry, there is the need to apply in predefined regions an adhesive material which is normally applied by means of nozzles provided for this purpose.

In order to increase the adhesion of the adhesive material to the sole, the sole is typically carded beforehand, in the region affected by the adhesive, by means of a mechanical operation performed by a milling cutter or the like, so as to facilitate the adhesion of the adhesive.

With current methods, carding must be performed on a dedicated machine, since the removed material must be first discarded; an additional step for applying the adhesive must be performed only after such material has been discarded.

Clearly, this method causes considerable problems, both because it is necessary to perform two separate passes and because in many cases it is quite difficult to apply the adhesive material exactly to the previously treated portion of surface.

SUMMARY OF THE INVENTION

The aim of the present invention is to eliminate the drawbacks noted above, by providing a head for applying adhesive in predefined regions of products in general which allows to considerably simplify all operating steps while having the assurance of performing optimum application of the adhesive.

Within the scope of this aim, a particular object of the present invention is to provide a head in which it is possible to easily control the operating sequence as regards both the carding step and the adhesive application step.

Another object of the present invention is to provide a head for applying adhesive in predefined regions of products in general which, thanks to its particular constructive characteristics, is capable of giving the greatest assurances of reliability and safety in use.

These and other objects which will become better apparent hereinafter are achieved by a head for applying adhesive in predefined regions of products in general, according to the invention, characterized in that it comprises at least one means for carding the surface to be treated which acts directly before at least one nozzle for applying a layer of adhesive material to the carded surface.

BRIEF DESCRIPTION OF THE DRAWINGS

Further characteristics and advantages of the present invention will become better apparent from the following detailed description of a preferred but not exclusive embodiment of a head for applying adhesives in predefined regions of products in general, illustrated only by way of non-limitative example in the accompanying drawings, wherein.

DESCRIPTION OF THE PREFERRED EMBODIMENTS

Figure 1:
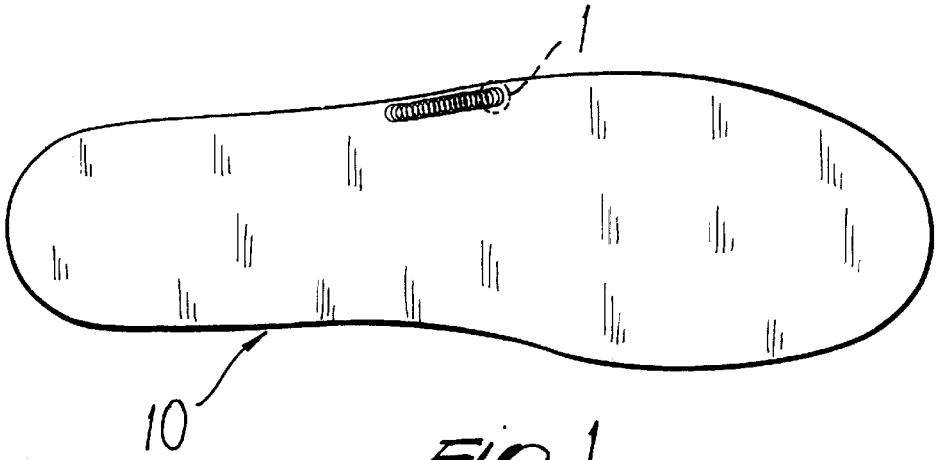
FIG. 1 is a schematic view of a sole for shoes, illustrating a carded portion, with adhesive applied thereto, along one edge.

With reference to the above figures, the head for applying adhesive in redefined regions of products in general, according to the invention, has a body, generally designated by the reference numeral 1, which can have a fixed part for introducing the adhesive material, which is generally constituted by a hot-melt product, and a rotating part, which in the described example is provided with three nozzles 2 which are mutually spaced by 120°.

Each nozzle is preceded by a carding means which can be of any type deemed suitable.

Experimental tests that have been conducted have shown that the use of a laser beam as a carding means yields optimum results, and for this purpose it is possible to provide heads in which there is a combination of one or more laser beams with a plurality of nozzles, generally in an odd number; it is also possible to optionally use a plasma jet.

The particular characteristic resides in the fact that the laser 3 in practice passes over the predefined region of the sole, generally designated by the reference numeral 10, producing a carding which will facilitate the adhesion of the adhesive.

It is essential that the beam be made to pass over regions that have not yet been affected by the application of adhesive material, since if the laser were to pass over the layer of adhesive, this would cause burns and regions without adhesion.

The head 1 rotates at a constant rate and the nozzles are tilted so as to contrast the effect caused by centrifugal force, so that a jet of adhesive material exits from each nozzle parallel to the generatrices of the rotating cylinder, performing, with the specific example, application along a triple spiral; the adhesive can also be applied by being in practice propelled against the sole by compressed air.

For optimum application, the sole 10 is moved at a speed which is slower than the peripheral speed of the nozzles, so that the adhesive material deposits along an epicycloid with three starts which are mutually offset by 120°.

As mentioned, the operation for carding or abrading the surface must be performed before the deposition of the adhesive material and only in the active part of the movement, i.e., in the part that lies ahead in the direction of rotation of the nozzle and in the direction of translatory motion with respect to the sole.

Figure 2:
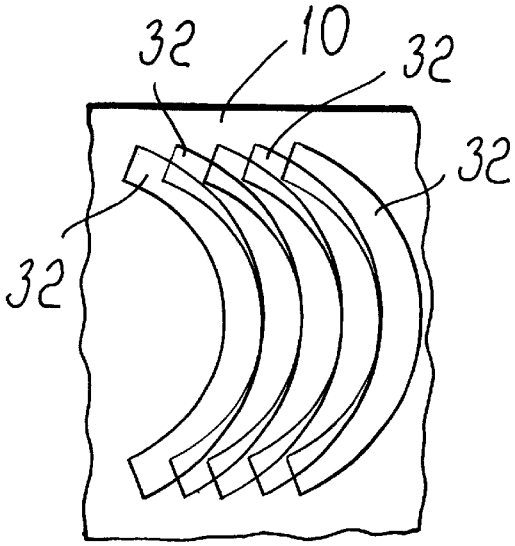
FIG. 2 is a schematic view of the spatial arrangement of the carding.
Figure 3:
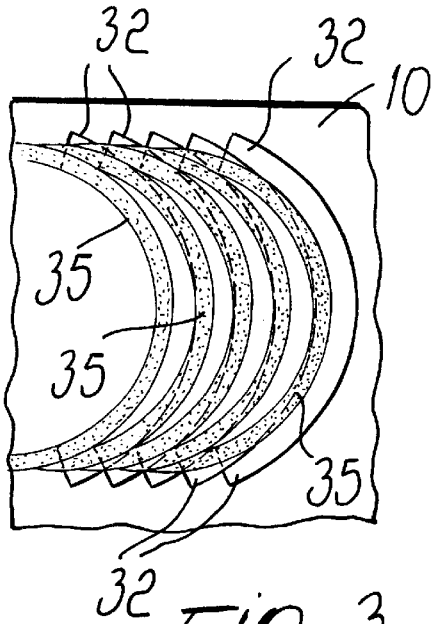
FIG. 3 is a view of the adhesive material applied to the carded regions.
Figure 4:
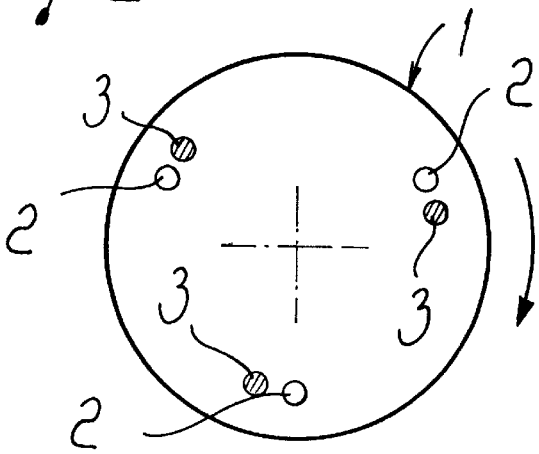
FIG. 4 is a schematic plan view of a possible embodiment of the rotating head with a plurality of nozzles.
Figure 5:
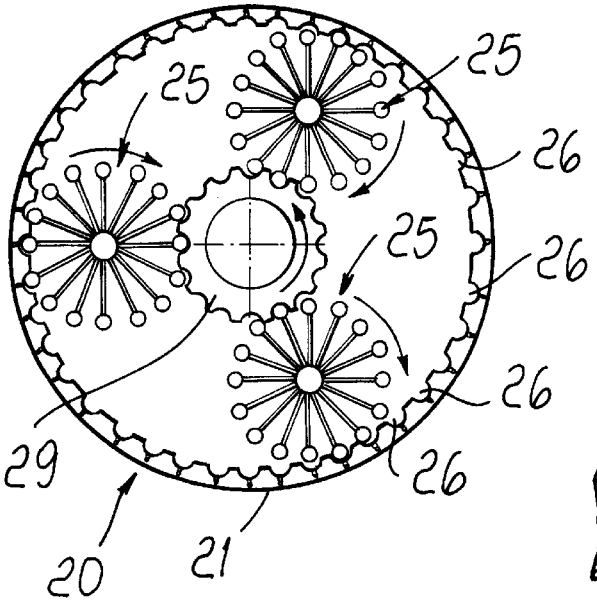
FIG. 5 is a schematic plan view of a multiple-nozzle head.
Figure 6:
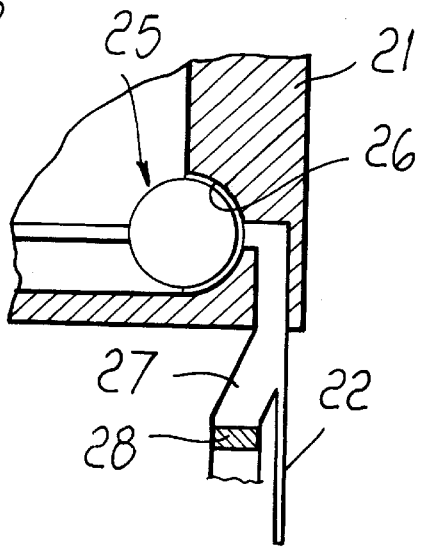
FIG. 6 is a sectional view of a nozzle for dispensing the adhesive for the multiple-nozzle head.
Figure 10:
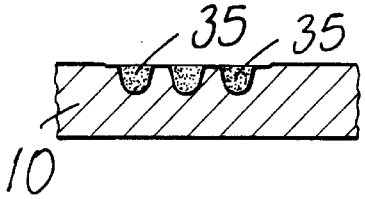
FIG. 10 is an enlarged-scale view of the application of the adhesive in the carded region.
Figure 12:
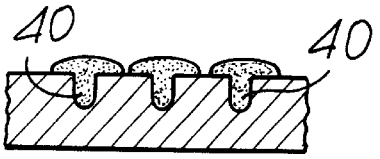
FIG. 12 is a view of a spot application of adhesive which penetrates the sole.
Figure 11:
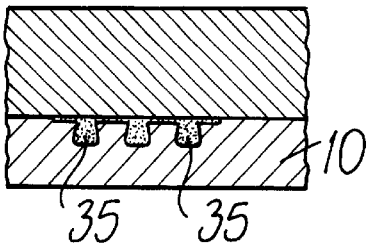
FIG. 11 is a view of the step for pressing and reactivating the adhesive.
Figure 13:
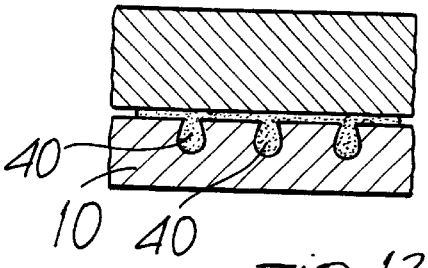
FIG. 13 is a view of the step for pressing and reactivating the adhesive.
Figure 7:
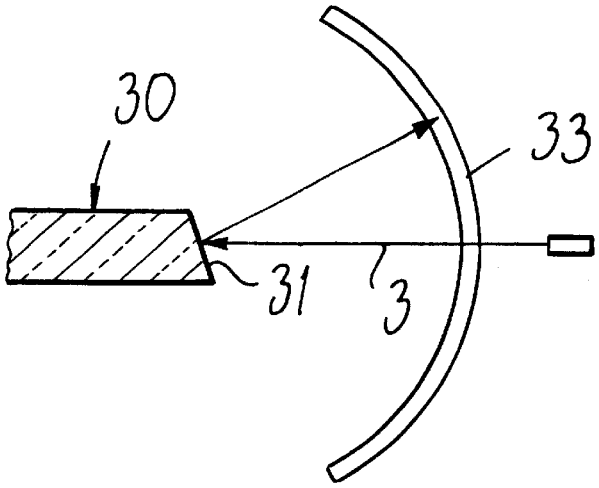
FIG. 7 is a schematic view of the disk for moving the laser beam that performs the carding.
Figure 8:
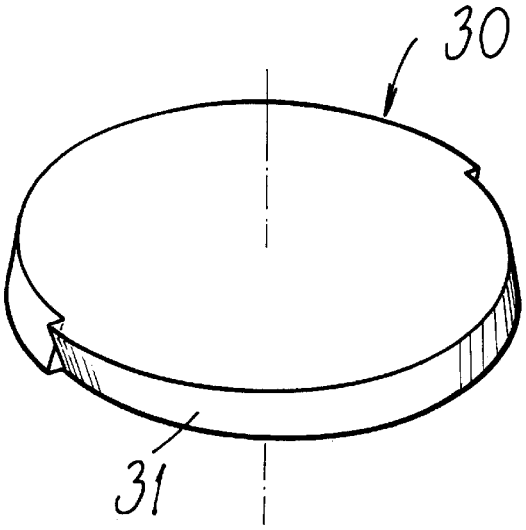
FIG. 8 is a schematic perspective view of the mirror-like disk.

In order to prevent the laser beam from affecting regions in which the adhesive 35 has already been applied, it is not possible to perform 180° carding with the laser beam, since excessive overlap would occur. Therefore it has been observed that optimum results are achieved by applying the laser beam, as shown in FIG. 2, over a partial annular region which spans 140–150°, taking into account that the emitted beam has large dimensions, so that, as shown in FIG. 2, good coverage is obtained, and the laser beam subsequently emitted in the right part relative to the drawings is applied to a region which is not yet affected by the adhesive. Moreover, it has been observed that it is optimum, in order to provide complete coverage, to use, for the annular regions affected by the laser beam that provides the coverage, a radius which is larger than the radius of application of the adhesive, thus achieving full coverage.

In order to obtain carding according to the above-described layout, it has been observed that it is optimum to provide a mirror for reflecting the laser beam which allows to perform scanning in the manner deemed optimum.

Schematically, the reflector mirror, designated by the reference numeral 30 in the drawing, has, on its peripheral region, an edge 31 whose surface inclination varies gradually with respect to the rotation axis so as to achieve the intended scanning for the laser beam.

On the peripheral region of the mirror disk 30 it is possible to provide one or more sectors according to the scanning speed to be achieved.

With the described arrangement, the laser beam, again designated by the reference numeral 3, strikes the peripheral edge 31 of the disk 30, so that the beam is reflected according to the inclination of the disk.

The continuous rotation of the disk 30 causes the intended angle to be covered in the intended time, forming the carding band 32, by means of secondary mirrors 33.

Figure 9:
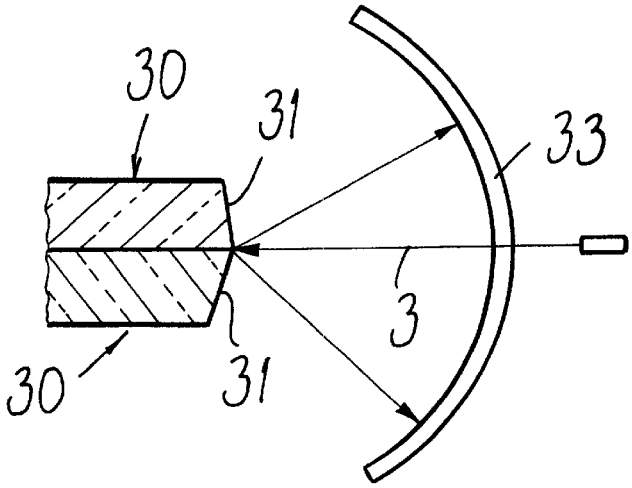
FIG. 9 is a schematic view of a two-disk mirror.

If one wishes to optimize the laser beam scanning step, it is possible to provide, as shown in FIG. 9, two mutually opposite disks 31 with a mirror-like surface, so that the sector to be treated is affected by one beam in one half and by the other beam in the other half.

The discontinuity that is formed at the various sectors having a variable inclination with respect to the axis in practice entails that when the end of the sector is reached the laser beam is instantaneously reflected to the opposite end and can thus continue its scanning operation.

A solution which is similar to the preceding one and uses a rotating head can also be achieved by means of a high-pressure multiple nozzle 20, which is constituted by a cylinder 21 having, in its peripheral region, a plurality of nozzles 22 which are distributed along its circumference and are affected in succession by the release of adhesive material. For this purpose, the multiple nozzle has star-shaped pistons, designated by the reference numeral 25, which are inserted in succession in recesses 26 which are connected to the nozzles 22 so that it is possible to perform the compression that causes the adhesive material to exit at high speed through the nozzle.

There is also provided a recycling circuit 27 which is controlled by a flow control element 28 which, owing to its larger cross-section, when open, causes the adhesive material to be sent directly to recycling instead of affecting the nozzle.

In practice, the multiple nozzle is internally saturated with pressurized adhesive, but the cross-section of the nozzles 22 is so small that the viscosity of the product prevents it from passing through them.

Each nozzle is connected to the adhesive-filled recess 26 which one of the star-shaped pistons 25 enters periodically; such piston, by means of a mechanical action, rapidly compresses the adhesive which, subjected to intense pressure, is able to escape at high speed through the narrow nozzle.

By way of this kinetic energy, the adhesive behaves like a point 40 and collides with the sole and can thus bite into it and penetrate it, thus generating a stronger point of adhesion.

In the meantime, the piston leaves the recess, producing a negative pressure which is insufficient to draw the adhesive that is present in the nozzle but is sufficient, once the piston has disengaged from the recess, to draw adhesive into the recess.

In practice, there are three star-shaped pistons grouped on three freely rotating wheels which are moved by a central wheel 29 which is rigidly coupled to a motor which in practice turns the pistons of the three wheels.

According to another solution, it is possible to use five star-shaped pistons with two laser beams, providing in practice the solution shown in FIG. 9. The number of pistons and the number of nozzles and laser beams can of course be changed in any way.

The piston turns at a constant rate, and therefore the delivery or not of the adhesive through the multiple nozzle is adjusted by the recycling valve, which simultaneously controls all the flow control elements 28 and which, if open, can discharge the adhesive compressed between the recess and the piston inside said multiple nozzle.

In all the above-cited solutions, the adhesive, after reactivation, is then subjected to a pressing step in order to connect the sole to the upper which in practice closes the sole (FIGS. 10–13), thus making adhesion even more stable.

From the above description it is thus evident that the invention achieves the intended aim and objects, and in particular the fact is stressed that a head for applying adhesive has been provided which allows to perform, in a single pass, both carding and adhesive application so as to always have excellent results by way of the fact that it is possible to precisely control both the carding region and the application region of the adhesive, which accordingly always adheres perfectly and is capable of providing the force that is necessary for adhesion.

The invention thus conceived is susceptible of numerous modifications and variations, all of which are within the scope of the inventive concept.

All the details may further be replaced with other technically equivalent elements.

In practice, the materials used, as well as the contingent shapes and dimensions, may be any according to requirements.

The disclosures in Italian Patent Application No. M199A001644 from which this application claims priority are incorporated herein by reference.

What is claimed is:

1. A head for applying adhesive in predefined regions of products, comprising at least one means for carding a surface to be treated which acts directly before at least one nozzle for applying a layer of adhesive material to the carded surface.

2. The head according to claim 1, wherein said at least one carding means is constituted by a laser beam.

3. The head according to claim 1, wherein said carding means is a plasma jet.

4. The head according to claim 1, comprising a plurality of nozzles for applying the adhesive layer which are arranged along a circumference of the head and are uniformly distributed.

5. The head according to claim 4, wherein each nozzle is adapted to release a jet of adhesive material substantially parallel to the generatrices of a rotation cylinder generated by the rotation of said head.

6. The head according to claim 4, wherein said plurality of nozzles is adapted to deposit the adhesive material, along an epicycloid with multiple starts, on a product which can move by translatory motion with respect to said head.

7. The head according to claim 2, wherein said beam is activated exclusively in regions not affected by the deposited adhesive material.

8. The head according to claim 2, wherein said laser beam is activated over a partial annular region which covers a sector defined by an angle of 140 to 150° and has a greater radius of curvature than a circumference along which said nozzles rotate, said angle being defined with respect to an imaginary center line drawn by said laser beam.

9. The head according to claim 2, comprising, for the emission of said laser beam along predefined circular portions, at least one disk with mirror surface for reflecting the laser beam which is peripherally provided with an edge whose inclination varies gradually with respect to the rotation axis so as to obtain, when said disk rotates, the scanning predefined for said laser beam.

10. The head according to claim 9, comprising, on said mirror, a plurality of sectors, each forming the angle of the scanning predefined for said laser beam.

11. The head according to claim 10, comprising two mutually opposite disks with mirror surfaces in order to split said laser beam onto two sectors arranged side by side.

12. The head according to claim 1, comprising a pressurized multiple-nozzle body which is constituted by a cylinder peripherally provided with a plurality of nozzles which are distributed along the circumference and are affected, in succession, by the emission of adhesive material, star-shaped pistons being provided inside said multiple-nozzle body and being able to enter recesses which are connected to said nozzles for compression in order to push the adhesive material through said nozzles.

13. The head according to claim 5, comprising a recycling circuit which is controlled by a flow control element, the aperture of said recycling circuit being substantially larger in cross-section than a useful cross-section of said nozzle in order to send the adhesive material to recycling when said flow control element is in an open position.

14. The head according to claim 1, comprising means for releasing at high pressure a jet of adhesive material for penetration of the jet of adhesive material in the product being treated, so as to bite into the surface to be treated.

* * * * *